US010851597B2

(12) United States Patent
Lynch et al.

(10) Patent No.: US 10,851,597 B2
(45) Date of Patent: Dec. 1, 2020

(54) UNTHREADED CASING THREAD PROTECTOR

(71) Applicant: Lynch Management Services, Inc., Buford, WY (US)

(72) Inventors: Robert C Lynch, Buford, WY (US); Bobby Don Walker, Jr., Tulsa, OK (US)

( * ) Notice: Subject to any disclaimer, the term of this patent is extended or adjusted under 35 U.S.C. 154(b) by 136 days.

(21) Appl. No.: 16/134,635

(22) Filed: Sep. 18, 2018

(65) Prior Publication Data

US 2019/0316422 A1 Oct. 17, 2019

Related U.S. Application Data

(60) Provisional application No. 62/657,123, filed on Apr. 13, 2018.

(51) Int. Cl.

| | |
|---|---|
| ***E21B 17/042*** | (2006.01) |
| ***E21B 17/12*** | (2006.01) |
| ***E21B 19/16*** | (2006.01) |
| ***B65D 59/06*** | (2006.01) |
| ***E21B 17/00*** | (2006.01) |

(52) U.S. Cl.
CPC ..... *E21B 17/006* (2013.01)

(58) Field of Classification Search
CPC ..... F16L 57/005; B65D 59/06; E21B 17/042; E21B 17/1042; E21B 17/12; E21B 19/16
See application file for complete search history.

(56) References Cited

U.S. PATENT DOCUMENTS

| | | | | |
|---|---|---|---|---|
| 4,337,799 | A * | 7/1982 | Hoover | F16L 57/005 138/89 |
| 4,757,595 | A * | 7/1988 | Fraering, Jr. | B65D 59/00 29/447 |
| 5,303,743 | A * | 4/1994 | Vincent | B65D 59/06 138/89 |
| 5,406,983 | A * | 4/1995 | Chambers | E21B 17/042 138/109 |
| 7,281,546 | B2 * | 10/2007 | Goodson | F16L 57/005 138/89 |
| 2016/0298400 | A1 * | 10/2016 | Sabatier | E21B 43/127 |

* cited by examiner

*Primary Examiner* — Catherine Loikith
(74) *Attorney, Agent, or Firm* — Leyendecker & Lemire LLC

(57) ABSTRACT

A combination of a casing tube and a closed end unthreaded tubular thread protector that has an inside diameter significantly greater than the outside diameter of the casing tube is described. Further, the thread protector is typically much longer than the threaded portion of the associated casing tube such that a significant amount of axial movement of the protector relative to the casing tube is required to remove it therefrom. The casing protector is most typically comprised of a polymeric material, such as polyethylene or polypropylene, that is soft enough as to not damage or mar the threads on the casing in which it is in contact, but stiff enough in the tubular form of the protector to prevent impact loads from being transferred to the threads there beneath.

3 Claims, 4 Drawing Sheets

UNTHREADED CASING THREAD PROTECTOR

RELATED APPLICATIONS

This application claims priority to and incorporates fully by reference U.S. provisional patent application No. 62/657,123 entitled Casing Thread Protector filed on Apr. 13, 2018 and having the same inventors.

BACKGROUND

Casings (or casing tubes) are typically used to line the bore of an oil or gas well while drilling the well and thereafter to maintain the integrity of the bore and preventing collapse thereof. After discreet lengths of casting are lowered down the bore, they are coupled with the previously lowered casing tube by way of a threaded joint. Casings typically have threaded male and female ends although casings with two male ends and a female-female coupler can also be used to join successive casings.

Typically, after the male threads are cut into the end of a casing during manufacture, they are covered with a thread protector that remains on the casing end until delivery to the site and inspection thereof. The thread protectors typically comprise plastic threaded caps that are tightly received over the threaded portion of the casing at its male-threaded end(s). The amount of friction associated with the tight grip of the threaded caps can make the unthreading and the removal of the caps time consuming. Under prior art practice, the threaded caps are removed from the casing ends for inspection after the casings are delivered to a site and then the caps are threaded back onto the ends of the casings to help ensure the threads don't get damaged while stored horizontally often in a rack near a rig with other casings pending use.

When needed for use a casing tube is typically rolled on to a pair of lifting arms which direct the pipe while still generally horizontal into an inclined conveyor trough. The conveyor trough is known in the field as a catwalk. The conveyor trough conveys the casing to the rig floor where it is hoisted vertically for placement down the well bore to be joined with previously lowered sections. On the rig floor, where rig time can easily and routinely exceed $2,000 an hour in 2018, the threaded thread protector cap is removed from one or both ends of the casing. If only three to six minutes are required to remove the protector from a casing end about $100-200 worth of productivity is lost for each casing joint installed in the bore. With the typical casing string consisting of 400-500 joints of casing, the lost time removing conventional threaded protectors is substantial.

DETAILED DESCRIPTION

Figure 1:
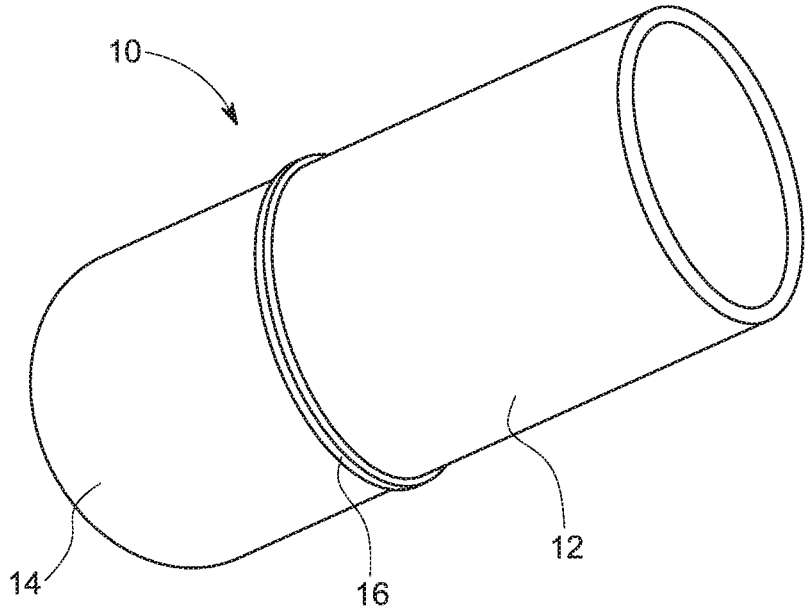
FIG. 1 is a first perspective view of a casing thread protector according to one embodiment of the present invention.

Embodiments of the invention comprise a closed end unthreaded tubular thread protector having an inside diameter significantly greater than the outside diameter of the associated casing over which it is received. Further, the thread protector is typically much longer than the threaded portion of the associated casing such that a significant amount of axial movement of the protector relative to the casing is required to remove it therefrom. The casing protector is most typically comprised of a polymeric material, such as polyethylene or polypropylene, that is soft enough not to damage or mar the threads on the casing in which it is in contact, but stiff enough in the tubular form of the protector to prevent impact loads from being transferred to the threads there beneath. Embodiments of the invention also comprise the protector in combination with a pipe casing wherein a protector is received over at least one end of the casing.

Another embodiment of the invention comprises the method of using the thread protector in the field. First, when the casing is received at the rig site, the as-shipped typically-threaded tight-fitting protector is removed. The threads of the casing are inspected. Instead of rethreading the as-shipped protector onto the end of the casing, an embodiment of the thread protector described herein is slid over the casing's end. The casing is then racked or otherwise stored in a substantially horizontal orientation for future use in the well bore. When ready for use, the casing is lifted on to a catwalk which conveys the casing upwardly to the drilling rig. Depending on the angle and length of the catwalk, the casing protector may fall off of the casing before reaching the rig; however, in many instances the protector is either easily removed by a rig worker while being prepared to be lifted vertically by the rig's hoist or the protector may fall of the casing as it is hoisted. The casing is then coupled to a proceeding casing and fed into the well bore. The casing protectors are later gathered for reuse. Advantageously, essentially no time or very little time is spent on the rig floor during the casing operation removing a casing protector from the casing thereby improving the efficiency of the casing operation.

Terminology

The terms and phrases as indicated in quotation marks (" ") in this section are intended to have the meaning ascribed to them in this Terminology section applied to them throughout this document, including in the claims, unless clearly indicated otherwise in context. Further, as applicable, the stated definitions are to apply, regardless of the word or phrase's case, to the singular and plural variations of the defined word or phrase.

The term "or" as used in this specification and the appended claims is not meant to be exclusive; rather the term is inclusive, meaning either or both.

References in the specification to "one embodiment", "an embodiment", "another embodiment, "a preferred embodiment", "an alternative embodiment", "one variation", "a variation" and similar phrases mean that a particular feature, structure, or characteristic described in connection with the embodiment or variation, is included in at least an embodiment or variation of the invention. The phrase "in one embodiment", "in one variation" or similar phrases, as used in various places in the specification, are not necessarily meant to refer to the same embodiment or the same variation.

The term "couple" or "coupled" as used in this specification and appended claims refers to an indirect or direct physical connection between the identified elements, components, or objects. Often the manner of the coupling will be related specifically to the manner in which the two coupled elements interact.

The term "directly coupled" or "coupled directly," as used in this specification and appended claims, refers to a physical connection between identified elements, components, or objects, in which no other element, component, or object resides between those identified as being directly coupled.

The term "approximately," as used in this specification and appended claims, refers to plus or minus 10% of the value given.

The term "about," as used in this specification and appended claims, refers to plus or minus 20% of the value given.

The terms "generally" and "substantially," as used in this specification and appended claims, mean mostly, or for the most part.

Directional and/or relationary terms such as, but not limited to, left, right, nadir, apex, top, bottom, vertical, horizontal, back, front and lateral are relative to each other and are dependent on the specific orientation of a applicable element or article, and are used accordingly to aid in the description of the various embodiments and are not necessarily intended to be construed as limiting.

An Embodiment of a Quickly Removable Casing Thread Protector

Figure 2:
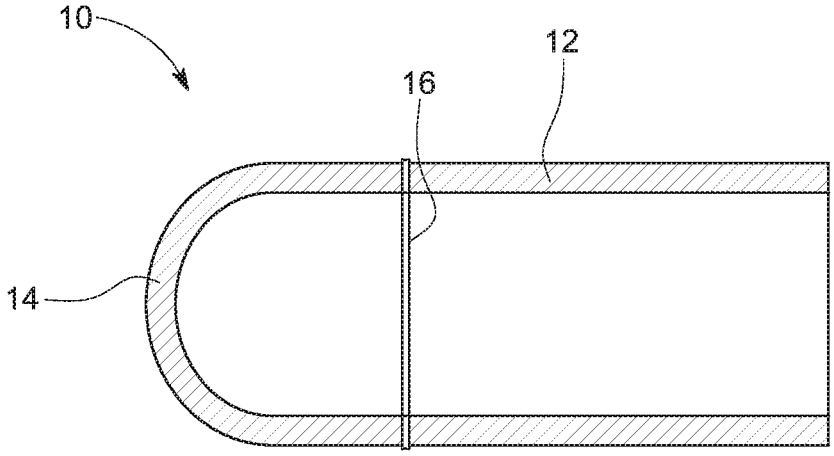
FIG. 2 is a cross sectional view of the casing thread protector according to one embodiment of the present invention.
Figure 3:
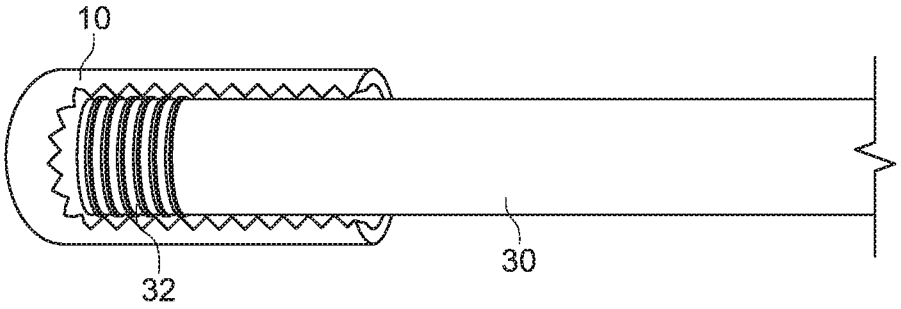
FIG. 3 shows a casing thread protector received on the end of a casing with a cutaway illustrating the threaded end of the casing according to one embodiment of the present invention.

An embodiment of an unthreaded casing thread protector 10 is shown in FIGS. 1 & 2. FIG. 3 shows the casing thread protector with a portion cutaway for illustrative purposes received over the end of a casing tube 30. As illustrated, the protector comprises a polymeric cylindrical tube with a closed end that has a relatively thick wall.

The protector 10 is typically fabricated from a piece of polyethylene or polypropylene tubing 12 and an associated end cap 14 made of the same material. The two pieces are plastic welded together as is indicated by the weld line 16 shown in the figures. The relative wall thickness of the tubing can vary depending on the properties of the material comprising the protector but is typically thick enough that when an impact load of the type and magnitude that may reasonably occur during normal drilling rig operation will not transfer from the protector to the underlying threads in a manner that would damage the threads. Thicknesses of 0.5" to 1.0" are typical.

As mentioned, the material comprising thread protector is most typically polyethylene or polypropylene; however, other plastic materials may be specified as well. Importantly, the material used should be substantially softer than the steel of the underlying threads such that even if the protector is driven against the threads by a load including an impact load, the surface of the protector will deform locally and the threads will remain unchanged and undamaged.

The dimensions of the protector 10 are related to the diameter of the casing tube 30 the protector is configured to protect as well as the length of the threaded portion 32 on the casing's end. Preferably, the inside diameter of the protector is 15-30% greater than the outside diameter of the casing, although protectors can be specified that have inside diameters as small as about 5% greater than the casing's outside diameter and as large as about 35% greater than the casing's outside diameter. Additionally, the length of the protector is typically much longer than the length of the casing threads preferably 2-4 times the length of the threads and more preferably about 3 times the length. The relative difference in the diameters permits the protector length to be easily removed from the casing end with little effort or time by rig workers despite its longer length.

As an example, a casing thread protector configured for use with a casing having an outside diameter of 5.5" and a 6" long male threaded section can have a inside diameter of 5.75"-7.25" and more preferably 6.375"-7.125". The protector can be about 12-24" in length. Additionally, the protector can be about 0.5"-1.0" in thickness. As can be appreciated the relative sizes of the protector are scaled accordingly for casing joints of different diameters and thread lengths.

Figure 4:
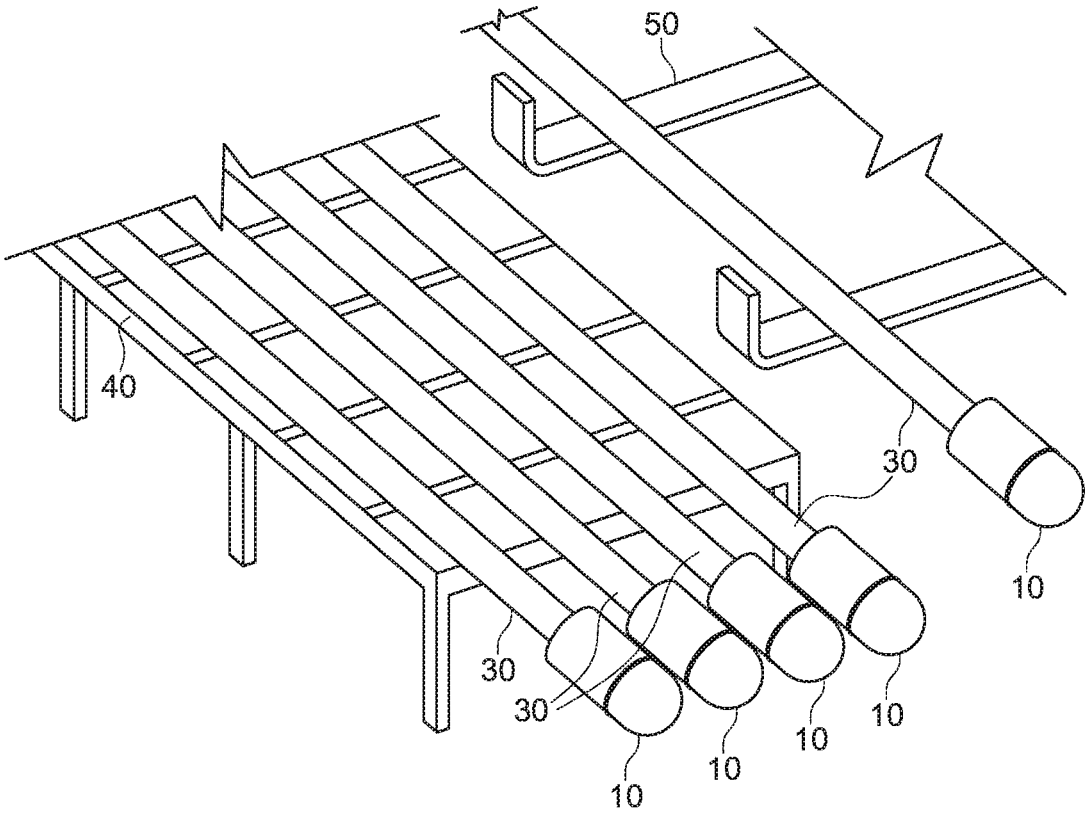
FIG. 4 is an illustration of a plurality of casings contained on a rack with casing protectors received over ends thereof according to one embodiment of the present invention.

Methods of Using Embodiments of a Quickly Removable Casing Thread Protector on a Drilling Rig FIG. 4 shows a stack of casings 30 on a rack 40 located near a rig awaiting eventual use. The casings each have a thread protector 10 installed over a threaded male end. The rack of casings illustrates how the casings can be stored or staged next to a drilling rig prior to use. When needed, a casing joint is rolled on to the lifting arms 50 seen behind the rack with a casing received thereon and moved onto the conveyor trough 62 of a catwalk 60 for transport up to the rig floor 70 to be inserted into the bore hole.

While the casing joints are stored on the rack 40, the end protectors 10 are held in place by way of friction as the protectors rest against other protectors and the associated casing's end. When lifted horizontally, the protectors typically remain in place as long as the casing is not tilted substantially off of horizontal. As can be appreciated, the length of the protector permits is to move axially along the casing a significant distance and still protect the casing's threaded end. For instance, an 18" long protector can move outwardly as much as 11-12" or so on a casing have a 6" long male threaded section without exposing the casing's threads.

Figure 5:
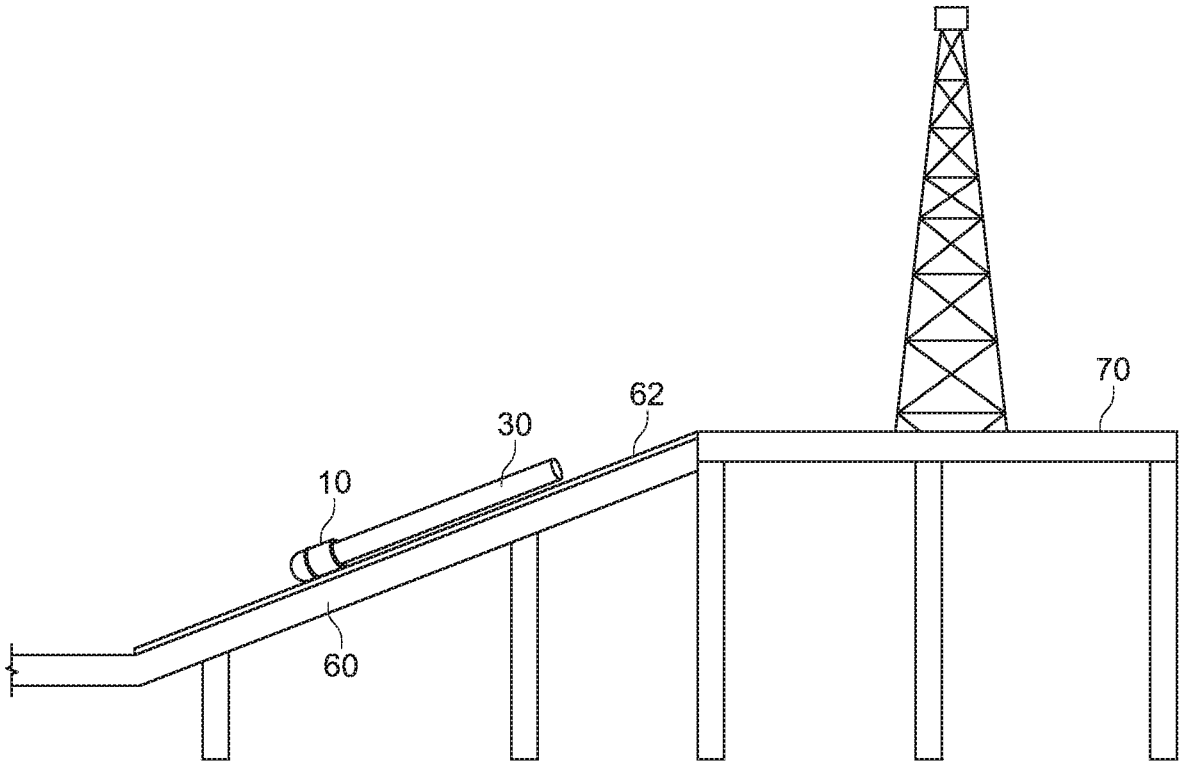
FIG. 5 is an illustration of a casing on a pipe wrangler conveyor with a casing protector covering a threaded end thereof according to one embodiment of the present invention.
Figure 6:
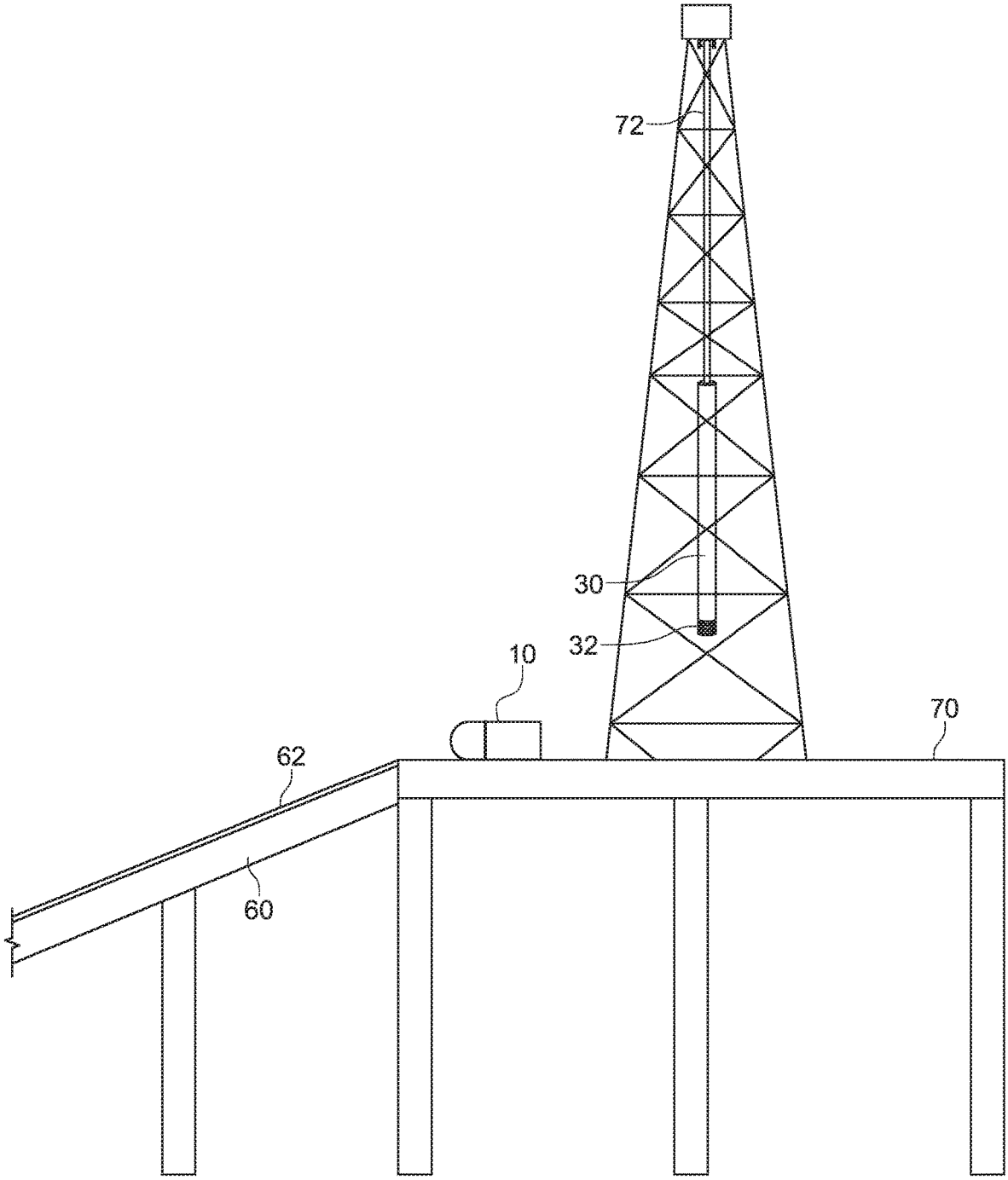
FIG. 6 is an illustration of a casing being lifted by a crane on the rig platform with the casing protector resting on the floor of the rig according to one embodiment of the present invention.

By way of the lifting arms 50 the casing 30 with the thread protector 10 thereon is moved to and placed in the catwalk's conveyor trough 62 where it is conveyed upwardly at an acute angle towards the rig floor 70. FIG. 5 illustrates a casing with a cover being conveyed towards the rig floor on a catwalk 60. As is shown, the male end of the casing with the protector installed thereon is usually facing downwardly and as the casing moves along the trough upwardly, the thread protector can slide or move relative to the casing and may eventually fall off of the casing end to expose the threads. Once the front end of the casing reaches the top of the catwalk, it is lifted into a vertical position by the rig hoist 72 to be lowered into the bore hole as shown in FIG. 6. If the thread protector has not fallen off the casing's male end, it will almost certainly do so when the casing is lifted vertically. If it does not, a simple quick tug from a rig work is typically all the addition encouragement required. The removed thread protector is cleared from the trough or rig floor and retained for future use.

As can be appreciated on smaller rigs, the thread protector 10 can be easily pulled off of the end of the casing once it is removed from the rack or the protector will often fall off of the casing when the casing is hoisted vertically. Through use of the unthreaded thread protector instead of the prior art threaded protector cap, rig time is not expended removing a thread protector from the casing end while it is hanging from the rig hoist saving substantial time and money in improved productivity.

Alternative Embodiments and Variations

The various embodiments and variations thereof, illustrated in the accompanying Figures and/or described above, are merely exemplary and are not meant to limit the scope of the invention. It is to be appreciated that numerous other variations of the invention have been contemplated, as would be obvious to one of ordinary skill in the art, given the benefit of this disclosure. All variations of the invention that read upon appended claims are intended and contemplated to be within the scope of the invention.

We claim:

1. A method of preparing a tubular casing for use in a well and conveying the casing to a drilling rig floor for installation in the well wherein the tubular casing has a casing outside diameter and at least one end with male threading extending a first axial distance along the tubular casing, the method comprising:

providing an unthreaded thread protector, the thread protector comprising a polymeric tube having a protector open end, a protector closed end, a protector inside diameter and a protector length with the protector inside diameter being 5-35% greater than the casing outside diameter and the protector length being at least twice as long as the first axial distance;

removing a threaded thread protector from the male threading; installing the unthreaded thread protector over the male threading and the at least one end;

placing a combination of the tubular casing and the unthreaded thread protector generally horizontally on a rack;

lifting and moving the combination of the tubular casing and the unthreaded thread protector generally horizontally onto a catwalk conveyor;

moving the combination of the tubular casing and the unthreaded thread protector along the conveyor towards the rig floor;

hoisting the tubular casing vertically above the rig floor; and removing the unthreaded thread protector from the tubular casing while moving along the conveyor, or while being hoisted above the rig floor.

2. The method of claim 1, wherein said removing the unthreaded thread protector comprises the unthreaded thread protector falling off of the at least one end while one of moving along the conveyor and hoisting the tubular casing vertically.

3. The method of claim 1, wherein said removing the unthreaded thread protector comprises a rig worker pulling the thread protector off of the tubular casing.

* * * * *